United States Patent [19]

Slopa

[11] 4,098,023

[45] Jul. 4, 1978

[54] LOCK AND SAFETY RELEASE FOR POWER OPERATED DOORS

[75] Inventor: Robert E. Slopa, Woodstock, Ill.

[73] Assignee: Hussmann Refrigeration, Inc., Bridgeton, Mo.

[21] Appl. No.: 748,383

[22] Filed: Dec. 7, 1976

[51] Int. Cl.[2] ..... E05F 15/00

[52] U.S. Cl. ..... 49/139

[58] Field of Search ..... 49/139, 26, 28, 98, 49/141; 70/279, DIG. 60, DIG. 70

[56] References Cited

U.S. PATENT DOCUMENTS 2,835,487 5/1958 Clark ..... 49/139

FOREIGN PATENT DOCUMENTS 421,433 12/1934 United Kingdom ..... 49/139

*Primary Examiner*—Kenneth Downey

*Attorney, Agent, or Firm*—Morsbach & Pillote

[57] ABSTRACT

A lock and safety release for power operated doors of the type in which the door is normally connected to a door operator for movement thereby, and in which the connection of the door to the door operator can be released to enable manual movement of the door. The lock and safety release includes inner and outer emergency release handles at opposite sides of the door which are selectively operable to disconnect the door from the door operator, and a lock mechanism for locking the outer emergency handle to prevent its operation to disconnect the door from the door operator and to also disable the door operator to prevent powered movement of the door by the door operator. The inner release handle remains operative to disconnect the door from the door operator to enable manual operation of the door when the outer handle is locked and the power operator is disabled.

10 Claims, 7 Drawing Figures

5
92
64a
10
52
64
61
85
97
69a
67a
58a
78
75
62a
69b
67
72
73
68
63a
79
76
62
63
81
75a
89
91
91a
88
88a 61
64a
64
52
65
66
85
58a
62
78b
96
76
97
75
78a
78
78c
81
75a
89
91

61
64a
52
65
64
66
85
78b
58a
96
62
97
76
78
75
78a
81
78c
75a
88
91
89
88a
90

43
41
41a
41b
42
42b
16a
16
44
42c
41c
51
41d
53a
52
55
56a
53b
53c
56b
54

LOCK AND SAFETY RELEASE FOR POWER OPERATED DOORS

BACKGROUND OF THE INVENTION

The present invention relates to power operated doors of the type in which the doors are reversibly moved between an open and closed position by a motor driven door operator actuated by one or more selectively operable control switches. Such power operated doors may, for example, be of the type disclosed in U.S. Patents of Robert E. Slopa et al, U.S. Pat. Nos. 2,927,788 and 3,261,128. In such power operated doors, it is also common practice to provide a releasable connection between the door and the door operator, which releasable connection is operable by emergency release handles located at both the inner and outer sides of the door to disconnect the doors from the door operator and allow manual movement of the door.

Locking of such power operated doors to prevent unauthorized entry from the outside, presents some problems. It is not satisfactory to merely lock the door to the door casing as is the custom with non-powered operated doors, since the power operator would remain operable and might be damaged if someone operated the control switch for the door operator while the door operator was locked. Moreover, even when it is desirable to lock the doors against unauthorized entry from outside, it is still necessary to allow the doors to be manually moved to their open positions from the inside of the room for emergency exit.

The U.S. patent to Clark, U.S. Pat. No. 2,835,487, discloses an apparatus for locking the doors from the outside in which a hasp is swingably attached to one door and is movable into engagement with a keeper attached to another door so that the doors can be locked in a closed position by a conventional padlock. The swingable hasp is arranged to operate a switch that disables the door operator, when the hasp is in its locked position, and the keeper is mounted so that it can be detached by manipulating a member on the inside of the other door so that the keeper while still locked to the hasp, can swing with the hasp to the open position of the latter. This mechanically unlocks the doors and also reestablishes power to the door operator. The doors can then be manually moved to their open position by operating the emergency release handle to disconnect the door from the door operator. Thus, in order to make an emergency exit from the room locked by the apparatus disclosed in the Clark patent, it is necessary to operate several different instrumentalities in a particular sequence. Moreover, as soon as the door is unlocked, power is reestablished to the door operator. This presents some possibility for injury to someone making an emergency exit, if the door operator is actuated while he is attempting to manually move the door. Further, after making an emergency exit through the doors, it is necessary to remove the padlock from the keeper and hasp, reassemble the keeper on the door, and thereafter move the door to its closed position, in order to enable relocking of the door.

SUMMARY OF THE INVENTION

It is the object of the present invention to overcome the disadvantages of the prior art by providing a lock and safety release for power operated doors in which the outer emergency release handle can be locked to both disable the power operator and to prevent the uncoupling of the door from the door operator in response to operation of the outer emergency release handle, and wherein the inner emergency release handle remains operable to disconnect the door from the door operator while the outer handle remains locked and the door operator remains disabled.

Accordingly, the present invention provides a lock and safety release for power operated doors of the type in which the motor driven door operator has mechanism for reversibly removing a door drive member along a path and control mechanism including one or more selectively operable control switches for controlling operation of the door operator, and a door connector latch carried by the door for releasably connecting the door to the door drive member for movement thereby, the lock and safety release comprising first and second emergency release handles at opposite sides of the door, means responsive to turning of the first release handle in a release mode for moving the door connector latch to a release position to decouple the door from the drive member, one-way coupling means operative when the second handle is turned for turning the first handle in its released mode, means for selectively locking the second handle against turning to prevent operation of the latch actuator means by the second emergency release handle while permitting operation of the latch actuator means by the first emergency release handle, door operator disabling switch means operable when actuated to prevent operation of the door operator by the control switches, and means for actuating the safety switch means when the second shaft is locked against turning.

These, together with other objects and features of the present invention will be more readily understood by reference to the following detailed description when taken in connection with the accompanying drawings wherein.

Figures 1, 2, 3:
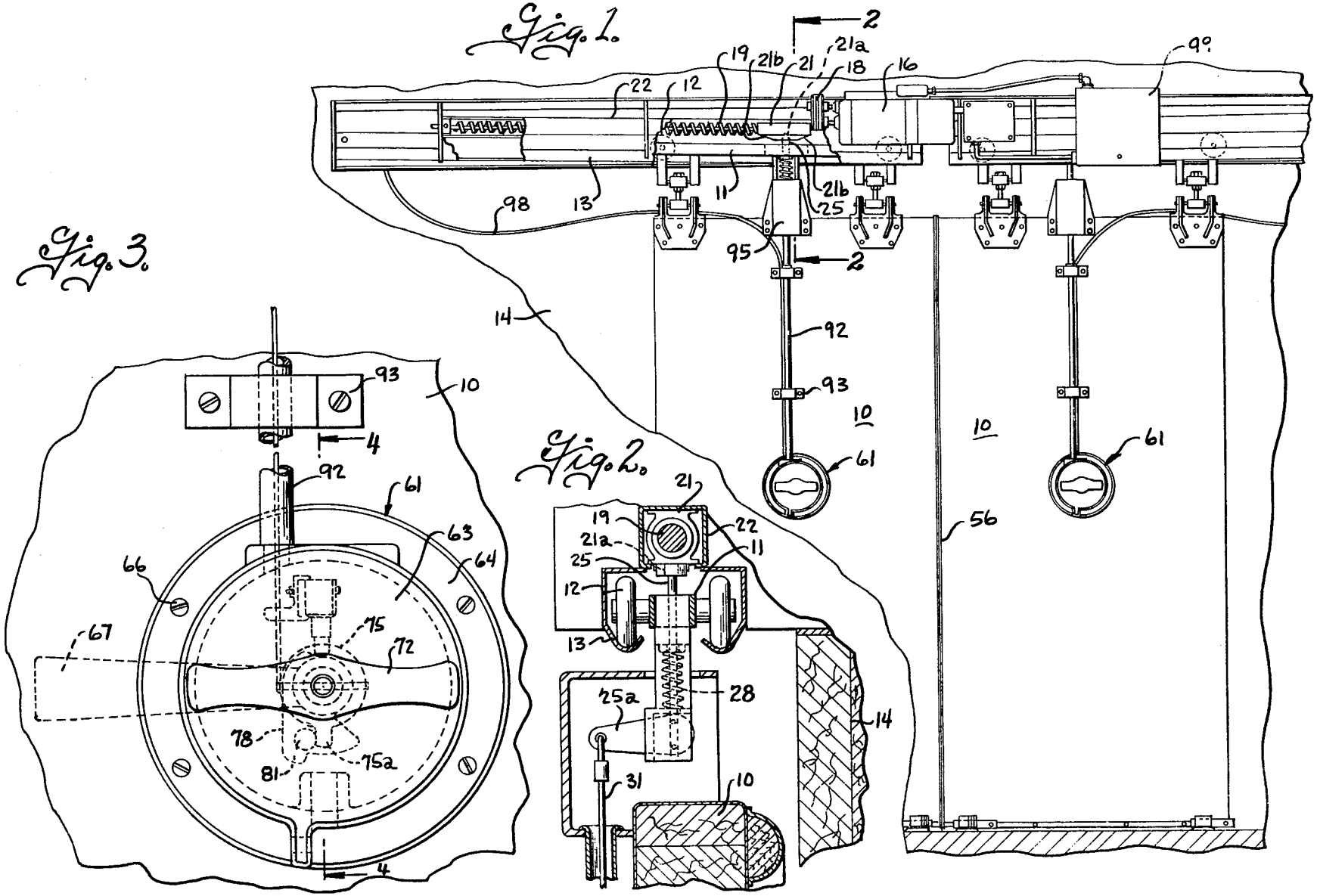
FIG. 1 is a fragmentary elevational view of a power operated door mechanism embodying the present invention.
FIG. 2 is a fragmentary vertical sectional view taken on the plane 2—2 of FIG. 1.
FIG. 3 is a fragmentary front elevational view of the lock and safety release shown on a larger scale than FIG. 1.
Figure 4:
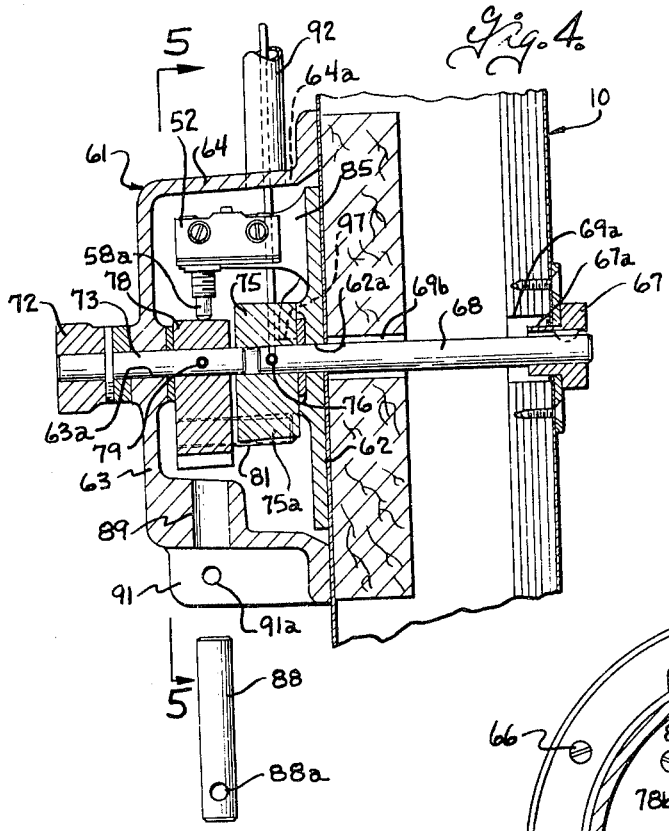
FIG. 4 is a vertical sectional view to the lock and safety release taken on the plane 4—4 of FIG. 3.

The present invention is generally adapted for use of power operated doors and is herein shown applied to a power operated door mechanism of the type shown in U.S. Pat. No. 3,261,128, the disclosure of which is hereby incorporated by reference for a more complete description of the construction and operation of the door operator. Although the power operated doors disclosed in that patent and in FIG. 1 are of the multiple or bi-parting type, the application of the lock and emergency release apparatus of the present invention to each door, whether in a bi-parting or single door installation, is substantially the same. Accordingly, to simplify description, the invention is herein specifically described applied to one door.

Each door 10 is supported on a carriage 11 mounted by rollers 12 on a trackway 13, for movement into and out of a position closing a door opening in wall 14. The door operator includes a drive motor 16 that is reversibly operable and which is connected through a speed reducer 18 to a traverse mechanism for moving a door drive member 21 individual to each door along a path paralleling the tracks 13. The traverse mechanism is herein shown as a lead screw 19 mounted in a housing 22 above each door. Each door drive member is movable along the respective housing 22 and has a follower that engages the threads on the respective lead screw so that the door drive member is moved along a path by the lead screw in directions determined by the direction of rotation of the respective lead screw. Each door 10 is releasably connected to the respective drive member 21 by a door connector latch 25. As best shown in FIGS. 1 and 2, the door connector latch is in the form of a pin releasably engageable in a socket **21*a* in the respective drive member 21. The pin is conveniently mounted on the carriage 11 for vertical movement relative thereto and is yieldably urged to its engaged position by a spring 28. A latch actuator 31 is connected to the door connector latch 25 and is herein shown in the form of a cable connected to a lateral arm 25*a* on the lower end of the door connector latch pin 25. As shown in FIG. 1, the door drive member 21 is advantageously formed with cam surfaces 21*b* at opposite ends to facilitate relocking of the door connector latch on the door drive member. The cam surfaces 21*b* are operative, when the door and drive member are moved relative to each other to engage the end of the latch 25 and cam the latch downwardly so that the latch can then move into the socket 21*a*** on the drive member when they are in alignment.

Figure 7:
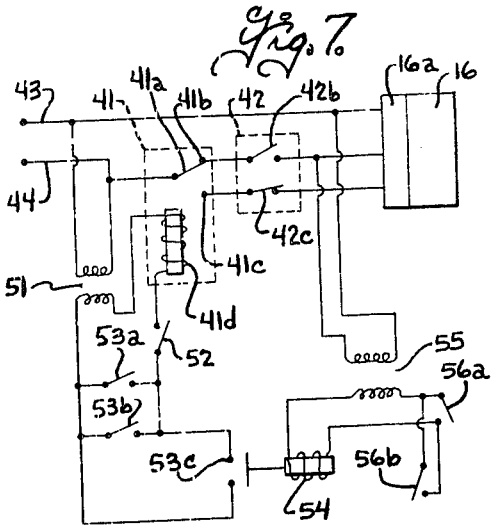
FIG. 7 is a schematic diagram of an electrical circuit for controlling the power operated door.

As schematically shown in FIG. 7, the drive motor 16 of the door operator is reversibly operated as from power conductors 43 and 44, under the control of a reversing switch 41, limit switch 42 and a motor controller **16*a*. The reversing switch 41 is operated between one position engaging contact 41*b* and a second position engaging contact 41*c*, each time the actuating solenoid 41*d* is energized. Contact 41*b* is connected through limit switch 42*b* to the motor controller 16*a* in a manner to drive the motor 16 in one direction and contact 41*c* is connected through limit switch 42*c* and to the motor controller 16*a* to drive the motor 16 in the reverse direction. As more fully described in the aforementioned U.S. Pat. No. 3,261,128, the limit switch 42 is conveniently driven from a power take-off from the motor and is so arranged that the limit switches 42*b* and 42*c* are normally closed and the switch 42*b* is opened when the door reaches a closed position and the switch 42*c*** opened when the door reaches an open position.

The solenoid **41*d* of the reversing switch is connected in a low voltage circuit energized from the secondary of transformer 51, the primary of which is connected to the power conductors 43 and 44. As schematically shown in FIG. 7, the coil of the solenoids 41*d* is connected through a normally closed door operator disabling switch 52 to one or more normally open door operator control switches designated 53*a*, 53*b* and 53*c*. Door operator control switches 53*a* and 53*b* can conveniently be manually operable push button switches located at opposite sides of the door to enable actuation of a door operator from either side of the door. A radio controlled switch (not shown) can be provided in parallel with or as a substitute for control switches 53*a*, 53*b*, if desired. Control switch 53*c* is a safety switch operated by solenoid 54. Solenoid 54 is also preferably connected in a low voltage circuit and, as shown, is connected in a circuit with the secondary of transformer 55, the primary of which is connected to conductor 43 and to the outlet side of limit switch 42*b* so that the safety switch circuit is energized only when the limit switch 42*b* is closed, and deenergized when it is opened. Safety switch solenoid 54 is operated under the control of normally open switches 56*a* and 56*b*, which switches are part of the safety edge 56** on the leading edges of the doors and which safety switches are so arranged as to be closed when the doors engage an obstruction.

Figure 5:
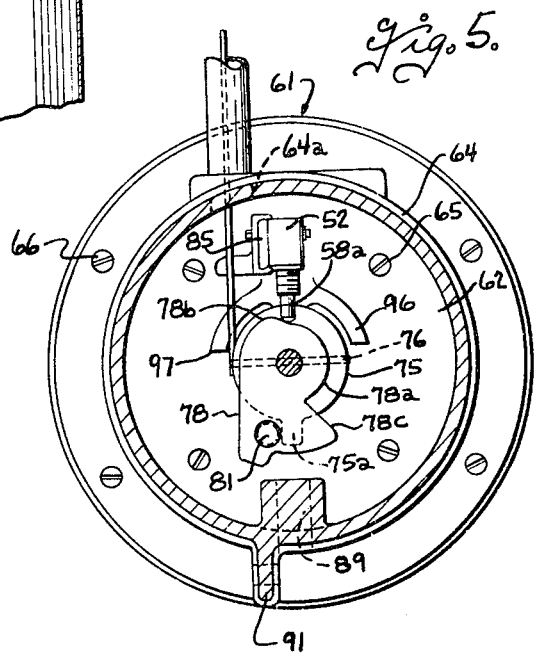
FIG. 5 is a vertical sectional view taken on the plane 5—5 of FIG. 4.
Figure 6:
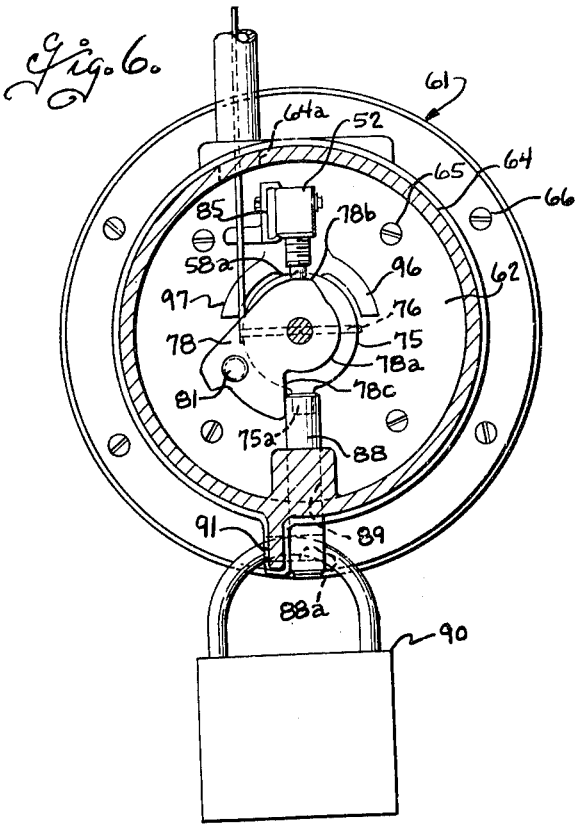
FIG. 6 is a vertical sectional view taken on the plane 5—5 of FIG. 4 and illustrating the part in a locked position.

Reference is now made more specifically to the lock and safety release 61 best shown in FIGS. 3–6. The lock and safety release includes a housing defining an enclosure having a back wall 62, a front wall 63 and a marginal wall 64. As best shown in FIGS. 5 and 6, the back wall 62 is attached to the outer side of the door 10 as by fasteners 65 and the front wall 63 and marginal wall 64 are preferably formed integrally to form a cup-shaped member that extends around the back wall 62 and which is also attached to the outer side of the door as by fasteners 66. The safety release includes a first handle 67 located at the inner side of the door and non-rotatably connected to a first shaft 68 that extends through openings **69*a* and 69*b* in the door and through an opening 62*a* in the back wall 62 of the housing. The shaft 68 is thus rotatably supported adjacent one end on the back wall of the housing, and the handle 67 has an integral collar 67*a* that is rotatably supported in a plate 71 at the inner side of the door. A second handle 72 is located at the outer side of the door and is non-rotatably connected to a second shaft 73, which shaft rotatably extends through an opening 63*a*** in the front wall of the housing.

A first cam 75 is non-rotatably attached as by a pin 76 to the first shaft 68 for turning therewith and the lower end of the latch actuator cable 31 extends downwardly through an opening **64*a* in the marginal wall 64 of the housing and is terminally attached to the cam 75 so as to be pulled downwardly when the cam 75 is turned in a counterclockwise direction as viewed in FIGS. 5 and 6, in what is herein referred to as a release mode. Thus, the door can be selectively disconnected from the door drive member 21 by turning the handle 67 in the inner side of the door in a clockwise direction as viewed from the inner side of the door. Provision is made for connecting the outer door handle 72 to the actuator cam 75 to also enable movement of the actuator cam in a release mode from the outer side of the door. However, provision is also made for locking the outer handle against operation and, in order to enable locking of the outer handle while continuing to allow operation of the inner handle, a one-way coupling is provided for drivingly connecting the second shaft to the first shaft. In the embodiment shown, a second cam member 78 is non-rotatably connected to the second shaft 73 as by a pin 79, and a drive pin 81 is provided on the second cam 78. The drive pin extends generally parallel to the first shaft 68 and is arranged to engage a drive dog 75*a* on the first cam 75, when the second cam is turned in a counterclockwise direction as viewed in FIG. 5, to thereby also turn the first cam 75** in a counterclockwise direction in its latch release mode.

The lock and safety release is arranged so that a single lock can be used to both lock the outer handle 72 against operation and to also disable the motor driven door operator. For this purpose, the door operating disabling switch 52 is mounted on a bracket 85 conveniently attached to the back wall 62 of the housing, with the switch actuator 58a positioned adjacent the periphery of the cam member 78. The switch 52 is normally closed and the cam member 78 has a first cam surface 78a generally concentric with the shaft 73 and spaced from the shaft a distance such that it does not actuate the switch, when the cam member 78 is moved in a counterclockwise direction from the position shown in FIG. 5. However, the cam member has a second cam portion 78b that merges smoothly with the end of the cam portion 78a and which is spaced radially farther from the shaft 73 to provide a lobe that operates the switch actuator 58a to its open position, when the cam member 78 is rotated in a clockwise direction from the position shown in FIG. 5 to a second position shown in FIG. 6. Provision is made for locking the cam member 78 in this second position, so that the door operator disabling switch 52 is actuated to disable the motor driven door operator, while the outer door operating handle 72 is locked against rotation in a direction to move the first cam 75 in its latched release mode. For this purpose, cam 75 is provided with a stop face 78c and a lock bar 88 is removably insertable through an opening 89 in the marginal wall of the housing 64 to engage the stop face 78c and thereby lock the same against turning. A lock 90, conveniently in the form of a conventional padlock, is adapted to be inserted through an opening 88a in the lock bar 88 and through an opening 91a in an ear 91 on the housing to lock the lock bar in position. Thus, the lock 90 and lock bar 88 lock the second cam 78 in a position in which the cam both operates the door operator disabling switch 52 and also locks the outer handle against turning in a direction to move the first cam 75 in its latched release mode. The inner handle 67 remains operative to move the first cam 75 in its release mode. Thus, in order to make an emergency exit, when the door is locked and the door operator disabled, it is only necessary to operate the inner door handle 67 and thereafter move the door manually to an open position. The door can thereafter be relocked by manually moving the door back to its closed position, at which time the latch 25 will re-engage the door drive member 21 and relock the door in its closed position. The latch actuator cable 31 is preferably enclosed in a tubular conduit 92 attached at its lower end to the housing 61 and secured to the door as by brackets 93. A housing 95 is advantageously provided at the upper end of the conduit 92 to enclose the upper end of the cable and the lower portion of the door connector latch, as best shown in FIGS. 1 and 2. Stops 96 and 97 are provided on the back plate 62 to engage the dog 75a and pin 81 for limiting annular movement of the cams 75 and 81. The conductors from the disabling switch 52 and the door edge switches 56a and 56b are connected through flexible cables 98 which extend from the moving doors to the other components of the door operator control conveniently located on the control panel 99.

From the foregoing it is believed that the construction and operation of the apparatus will be readily understood. When the lock and safety release are in their unlocked condition, the door operator can be operated under the control of control switches such as 53a or 53b. If the doors are closed, limit switch 42b will be in its open position as shown in FIG. 7 and a three-way switch 41 will be in engagement with contact 41b. Upon actuation of one of the control switches, the three-way switch 41a is moved into engagement with the other contact 41c and this establishes a circuit through limit switch 42c and motor controller 16a to the motor 16 to operate the doors to their open position. As the door moves to the open position, limit switch 42b closes and, when the door reaches the open position, limit switch 42c is opened to thereby stop the doors. The doors will be similarly operated back to their closed position upon a succeeding actuation of the control switch 53a or 53b, except that the three-way switch is then moved back to the position engaging contact 41b and establishing a circuit through limit switch 42b and through motor controller 16a to the motor 16 to operate the same in a direction to reclose the doors. If the safety edges 56 engage an obstruction, they will actuate one of the switches 56a or 56b and close safety switch 56c which will effect an automatic reversing of the door to open the same. In the event of a power failure or failure of the door operator, the door can be released or decoupled from the door operator from either the inside or outside of the door by operating the corresponding handle 67 or 72.

When the outer handle is locked in the position shown in FIG. 6, the door operator is disabled so that it cannot be operated under the control of switches 53a and 53b and, moreover, the outer handle is also locked against turning the latch actuator cam 75 in its release mode. The inner handle 67, however, remains operative to turn the latch actuator cam in its release mode to disconnect the door from the door drive member so that the door can be manually opened. The outer handle, however, remains locked and the door operator remains disabled so that the door drive member remains stationary. Thus, the door can thereafter be automatically relocked by manually moving the cam back to its closed position, until the door connector latch moves into the socket in the door drive member.

The embodiments of the invention in which an exclusive property or privilege is claimed are defined as follows:

1. A lock and safety release for power operated doors of the type including a motor driven door operator operable to reversibly move a door drive member along a path, means including selectively operable control switch means for controlling operation of said door operator, and a door connector latch carried by the door for releasably coupling the door to the door drive member for movement thereby, said lock and safety release comprising first and second emergency release handles at opposite sides of the door, latch actuator means operable in a release mode for moving said door connector latch to a release position whereby to decouple the door from the door drive member, means responsive to operation of either the first or the second emergency release handle for operating said latch actuator means in its release mode, means for locking said second emergency release handle against operation without locking said first emergency release handle against operation whereby to prevent the second handle from operating the latch actuator means in its release mode while continuing to allow the first handle to operate the latch actuator means in its release mode, door operator disabling switch means operable when actuated to prevent operation of said door operator by said control switch means, and means for actuating said door operator disabling switch means when said second emergency release handle is locked against operation.

2. A lock and safety release for power operated doors of the type including a door and a motor driven door operator having means for reversibly moving a door drive member along a path, means including selectively operable control switch means for controlling operation of said door operator, and a door connector latch carried by the door for releasably connecting the door to the door drive member for movement thereby, said lock and safety release comprising, first and second emergency release handles at opposite sides of the door and respectively connected to first and second shafts, latch actuator means operable in response to turning of said first shaft in a release mode for moving said door connector latch to a release position whereby to decouple the door from the door drive member, one-way coupling means operative when said second shaft is turned for turning said first shaft in said release mode, means for selectively locking said second shaft against turning whereby to prevent operation of the latch actuator means by the second emergency release handle while permitting operation of the latch actuator means by the first emergency release handle, door operator disabling switch means operable when actuated to prevent operation of said door operator by said control switch means, and means for actuating said disabling switch means when said second shaft is locked against turning.

3. A lock and safety release according to claim 2 wherein said means for actuating said disabling switch means comprises a cam member on said second shaft.

4. A lock and safety release according to claim 2 wherein said means for actuating said disabling switch means comprises a cam member on said second shaft, said means for locking said second shaft against turning including means engageable with said cam member when the second shaft is in a preselected position.

5. A lock and safety release according to claim 2 wherein said first and second shafts are axially aligned, said one-way coupling means comprising first and second cam members on the adjacent ends of said first and second shafts respectively.

6. A lock and safety release according to claim 5 wherein said means for actuating said disabling switch means comprises cam means on said second cam member for actuating said disabling switch means when said second cam member is in a preselected position.

7. A lock and safety release according to claim 6 wherein said means for locking said second shaft against turning includes means engageable with said second cam member when the latter is in said preselected position.

8. A lock and safety release for power operated doors of the type including a motor driven door operator operable to reversibly move a door drive member along a path, means including control switch means for controlling operation of said door operator, and a door connector latch carried by the door for releasably coupling the door to the door drive member for movement thereby, said safety release comprising: a housing defining an enclosure having spaced front and back walls and a marginal wall extending between the front and back walls, means for attaching the housing to the door, an inner emergency release handle at the inner side of the door and connected to a first shaft rotatably supported in the back wall of the housing, an outer emergency release handle at the outer side of the door and connected to a second shaft rotatably supported in the front wall of the housing, latch actuator means including a first cam member on said first shaft and operable in response to turning of said first shaft in a release mode for moving the door connector latch to a release position whereby to decouple the door from the door drive member, one-way coupling means including a second cam member on the second shaft operative when the second shaft is turned in one direction for turning the first shaft in said release mode, means for selectively locking said second shaft against turning whereby to prevent operation of the latch actuator by the outer emergency release handle while permitting operation of the latch actuator means by the inner emergency release handle, door operator disabling switch means operable when actuated to prevent operation of said door operator by said control switch means, and means for actuating said disabling switch means when said second shaft is locked against turning.

9. A lock and safety release according to claim 8 wherein said second cam member has cam means thereon for actuating said disabling switch means when the second shaft is in a preselected position, and said means for locking said second shaft against turning includes means engageable with said second cam member when the second shaft is in said preselected position.

10. A lock and safety release according to claim 9 wherein said means for locking said second shaft against turning includes an opening in said housing, a pin movable through said opening into engagement with said second cam member, and lock means for securing said pin to said housing.

* * * * *